US005259184A

United States Patent [19]

Borkowicz et al.

[11] Patent Number: 5,259,184

[45] Date of Patent: Nov. 9, 1993

[54] DRY LOW NOX SINGLE STAGE DUAL MODE COMBUSTOR CONSTRUCTION FOR A GAS TURBINE

[75] Inventors: Richard Borkowicz, Westminster, Md.; David T. Foss; Daniel M. Popa, both of Schenectady, N.Y.; Warren J. Mick, Altamont, N.Y.; Jeffery A. Lovett, Scotia, N.Y.

[73] Assignee: General Electric Company, Schenectady, N.Y.

[21] Appl. No.: 859,006

[22] Filed: Mar. 30, 1992

[51] Int. Cl.[5] ..... F23R 3/36; F02C 3/20

[52] U.S. Cl. ..... 60/39.55; 60/737; 60/742

[58] Field of Search ..... 60/732, 733, 737, 738, 60/740, 742, 746, 747, 748, 39.55

[56] References Cited

U.S. PATENT DOCUMENTS

| | | | |
|---|---|---|---|
| 2,955,420 | 10/1960 | Schirmer | 60/39.06 |
| 2,993,338 | 7/1961 | Wilsted | 60/39.74 |
| 2,999,359 | 9/1961 | Murray | 60/39.65 |
| 3,048,014 | 8/1962 | Schmidt | 60/39.23 |
| 3,149,463 | 9/1964 | Withers et al. | 60/39.74 |
| 3,164,200 | 1/1965 | Reed | 158/11 |
| 3,792,582 | 2/1974 | Markowski | 60/39.72 R |
| 3,899,881 | 8/1975 | Arvin et al. | 60/39.65 |
| 3,912,164 | 10/1975 | Lefebvre et al. | 239/5 |
| 3,946,553 | 3/1976 | Roberts et al. | 60/39.74 |
| 3,958,416 | 5/1976 | Hammond, Jr. et al. | 60/39.65 |
| 3,973,395 | 8/1976 | Markowski et al. | 60/39.65 |
| 4,112,676 | 9/1978 | DeCorso | 60/39.71 |
| 4,173,118 | 11/1979 | Kawaguchi | 60/39.65 |
| 4,193,260 | 3/1980 | Carlisle et al. | 60/737 |
| 4,262,482 | 4/1981 | Roffe et al. | 60/736 |
| 4,292,801 | 10/1981 | Wilkes et al. | 60/39.06 |
| 4,337,618 | 7/1982 | Hughes et al. | 60/39.55 |
| 4,389,848 | 6/1983 | Markowski et al. | 60/738 |
| 4,420,929 | 12/1983 | Jorgensen et al. | 60/39.06 |
| 4,425,755 | 1/1984 | Hughes | 60/39.55 |
| 4,483,137 | 11/1984 | Faulkner | 60/39.55 |
| 4,498,288 | 2/1985 | Vogt | 60/39.06 |
| 4,587,809 | 5/1986 | Ohmori et al. | 60/737 |
| 4,589,260 | 5/1986 | Krockow | 60/737 |
| 4,600,151 | 7/1986 | Bradley | 60/39.55 |
| 4,683,715 | 8/1987 | Iizuka et al. | 60/39.06 |
| 4,698,963 | 10/1987 | Taylor | 60/39.06 |
| 4,701,124 | 10/1987 | Maghon et al. | 431/284 |
| 4,716,719 | 1/1988 | Takahashi et al. | 60/39.06 |
| 4,726,182 | 2/1988 | Barbier et al. | 60/39.23 |
| 4,726,192 | 2/1988 | Willis et al. | 60/737 |
| 4,763,481 | 8/1988 | Cannon | 60/737 |
| 4,787,208 | 11/1988 | DeCorso | 60/723 |
| 4,805,411 | 2/1989 | Hellat et al. | 60/733 |
| 4,850,194 | 7/1989 | Füglistaller et al. | 60/737 |
| 4,901,524 | 2/1990 | Shekleton et al. | 60/39.465 |
| 4,974,415 | 12/1990 | Shekleton et al. | 60/733 |
| 4,982,570 | 1/1991 | Waslo et al. | 60/733 |
| 4,984,429 | 1/1991 | Waslo et al. | 60/752 |
| 4,996,837 | 3/1991 | Shekleton | 60/39.36 |
| 5,039,018 | 8/1991 | Olsson | 239/406 |
| 5,054,280 | 10/1991 | Ishibashi et al. | 60/39.06 |
| 5,062,792 | 11/1991 | Maghon | 431/284 |
| 5,069,029 | 12/1991 | Kuroda et al. | 60/737 |
| 5,127,229 | 7/1992 | Ishibashi et al. | 60/747 |

FOREIGN PATENT DOCUMENTS

| | | |
|---|---|---|
| 0108361 | 5/1984 | European Pat. Off. . |
| 0269824 | 6/1988 | European Pat. Off. . |

OTHER PUBLICATIONS

GE Turbine Reference Library—"Dry Low NOx Combustion for GE Heavy-Duty Gas Turbines", Dr. L. B. Davis, Jr. (no date).

*Primary Examiner*—Richard A. Bertsch
*Assistant Examiner*—Timothy S. Thorpe
*Attorney, Agent, or Firm*—Nixon & Vanderhye

[57] ABSTRACT

In a gas turbine (10), a plurality of combustors (14), each having a plurality of fuel nozzles (32) arranged about a longitudinal axis of the combustor, and a single combustion zone (70), each fuel nozzle having a diffusion passage (74) and a premix passage (60), the premix passage communicating with a plurality of premix fuel distribution tubes (66) located within a dedicated premix tube (46) adapted to mix the premix fuel and combustion air prior to entry into the single combustion zone (70) located downstream of the premix tube (46).

12 Claims, 4 Drawing Sheets

DRY LOW NOX SINGLE STAGE DUAL MODE COMBUSTOR CONSTRUCTION FOR A GAS TURBINE

RELATED APPLICATIONS

This application is related generally to commonly owned application Ser. No. 07/859,007 filed concurrently with this application, the entirety of which is incorporated herein by reference; and to commonly owned application Ser. Nos. 07/501,439, now U.S. Pat. No. 4,982,570; 07/618,246 now abandoned and 07/680,073, now U.S. Pat. No. 5,199,205; filed Mar. 22, 1990, Nov. 27, 1970 and Apr. 3, 1991, respectively.

TECHNICAL FIELD

This invention relates to gas and liquid fueled turbines, and more specifically, to combustors in industrial gas turbines used in power generation plants.

BACKGROUND ART

Gas turbines generally include a compressor, one or more combustors, a fuel injection system and a turbine. Typically, the compressor pressurizes inlet air which is then turned in direction or reverse flowed to the combustors where it is used to cool the combustor and also to provide air to the combustion process. In a multi-combustor turbine, the combustors are located about the periphery of the gas turbine, and a transition duct connects the outlet end of each combustor with the inlet end of the turbine to deliver the hot products of the combustion process to the turbine.

In an effort to reduce the amount of NOx in the exhaust gas of a gas turbine, inventors Wilkes and Hilt devised the dual stage, dual mode combustor which is shown in U.S. Pat. No. 4,292,801 issued Oct. 6, 1981 to the assignee of the present invention. In this aforementioned patent, it is disclosed that the amount of exhaust NOx can be greatly reduced, as compared with a conventional single stage, single fuel nozzle combustor, if two combustion chambers are established in the combustor such that under conditions of normal operating load, the upstream or primary combustion chamber serves as a premix chamber, with actual combustion occurring in the downstream or secondary combustion chamber. Under this normal operating condition, there is no flame in the primary chamber (resulting in a decrease in the formation of NOx), and the secondary or center nozzle provides the flame source for combustion in the secondary combustor. The specific configuration of the patented invention includes an annular array of primary nozzles within each combustor, each of which nozzles discharges into the primary combustion chamber, and a central secondary nozzle which discharges into the secondary combustion chamber. These nozzles may all be described as diffusion nozzles in that each nozzle has an axial fuel delivery pipe surrounded at its discharge end by an air swirler which provides air for fuel nozzle discharge orifices.

In U.S. Pat. No. 4,982,570, there is disclosed a dual stage, dual mode combustor which utilizes a combined diffusion/premix nozzle as the centrally located secondary nozzle. In operation, a relatively small amount of fuel is used to sustain a diffusion pilot whereas a premix section of the nozzle provides additional fuel for ignition of the main fuel supply from the upstream primary nozzles directed into the primary combustion chamber.

In a subsequent development, a secondary nozzle air swirler previously located in the secondary combustion chamber downstream of the diffusion and premix nozzle orifices (at the boundary of the secondary flame zone), was relocated to a position upstream of the premix nozzle orifices in order to eliminate any direct contact with the flame in the combustor. This development is disclosed in the above identified co-pending '246 application.

Perhaps the most important attribute of a dry low NOx combustor is its ability to premix fuel and air before burning. In addition to good premixing quality, the combustor must be able to operate in a stable manner over a wide range of gas turbine cycle conditions. The problems addressed by this invention relate to the degree of premixing prior to burning, and the maintenance of stability throughout the premixed operating range.

DISCLOSURE OF INVENTION

This invention relates to a new dry low NOx combustor specifically developed for industrial gas turbine applications. The combustor is a single stage (single combustion chamber or burning zone) dual mode (diffusion and premixed) combustor which operates in a diffusion mode at low turbine loads and in a premixed mode at high turbine loads. Generally, each combustor includes multiple fuel nozzles, each of which is similar to the diffusion/premix secondary nozzle as disclosed in the '246 application. In other words, each nozzle has a surrounding dedicated premixing section or tube so that, in the premixed mode, fuel is premixed with air prior to burning in the single combustion chamber. In this way, the multiple dedicated premixing sections or tubes allow thorough premixing of fuel and air prior to burning, which ultimately results in low NOx levels.

More specifically, each combustor in accordance with this invention includes a generally cylindrical casing having a longitudinal axis, the combustor casing having fore and aft sections secured to each other, and the combustion casing as a whole secured to the turbine casing. Each combustor also includes an internal flow sleeve and a combustion liner substantially concentrically arranged within the flow sleeve. Both the flow sleeve and combustion liner extend between a double walled transition duct at their forward or downstream ends, and a sleeve cap assembly (located within a rearward or upstream portion of the combustor) at their rearward ends. The outer wall of the transition duct and at least a portion of the flow sleeve are provided with air supply holes over a substantial portion of their respective surfaces, thereby permitting compressor air to enter the radial space between the combustion liner and the flow sleeve, and to be reverse flowed to the rearward or upstream portion of the combustor, where the air flow direction is again reversed, to flow into the rearward portion of the combustor and towards the combustion zone.

In accordance with this invention, a plurality (five in the exemplary embodiment) of diffusion/premix fuel nozzles are arranged in a circular array about the longitudinal axis of the combustor casing. These nozzles are mounted in a combustor end cover assembly which closes off the rearward end of the combustor. Inside the combustor, the fuel nozzles extend into a combustion liner cap assembly and, specifically, into corresponding ones of the premix tubes. The forward or discharge end of the nozzle terminates within the premix tube, in relatively close proximity to the downstream opening of the premix tube. An air swirler is located radially between each nozzle and its associated premix tube at the rearward or upstream end of the premix tube, to swirl the combustion air entering into the respective premix tube for premixing with fuel as described in greater detail below.

The forward ends of the premix tubes are supported within a front plate of the combustion liner cap assembly, the front plate not only having relatively large holes substantially aligned with the fuel nozzles, but also having substantially the entire remaining surface thereof formed with a plurality of cooling apertures which serve to supply cooling air to a group of shield plates located at the forward edges of the premix tubes, adjacent and downstream of the front plate. The details of the combustion liner cap assembly form the subject matter of the above noted co-pending application Ser. No. 07/859,007.

Each fuel nozzle in accordance with the invention is provided with multiple concentric passages for introducing premix gas fuel, diffusion gas fuel, combustion air, water (optional), and liquid fuel into the combustion zone. The gas and liquid fuels, combustion air and water are supplied to the combustor by suitable supply tubes, manifolds and associated controls which are well understood by those skilled in the art, and which form no part of this invention. The various concentric nozzle passages are referred to below as the first, second, third, fourth and fifth passages, corresponding to the radially outermost to the radially innermost, i.e., the center or core passage.

Premix gas fuel is introduced by means of a first nozzle passage which communicates with a plurality (eleven in the illustrated embodiment) of radially extending fuel distribution tubes arranged about the circumference of the nozzle, intermediate the rearward and forward ends of the nozzle, and toward the rearward end of the premix tube.

The second nozzle passage supplies diffusion fuel to the burning zone, exiting the nozzle at the forward or discharge end thereof, but still within the associated premix tube.

The third nozzle passage supplies combustion air to the burning zone, exiting the nozzle downstream end where it mixes with combustion air from the second passage.

A fourth optional nozzle passage may be provided to supply water to the burning zone to effect NOx reductions as is well understood by those skilled in the art.

A fifth, center or core passage supplies liquid fuel to the burning zone as a gas fuel backup, i.e., the liquid fuel is supplied only in the event of an interruption in the gas fuel supply.

The combustor in accordance with this invention operates as a single stage (single combustion chamber or burning zone), dual mode (diffusion and premix) combustor. Specifically, at low turbine loads, diffusion gas fuel is supplied through the diffusion gas passage (the second passage) and is discharged through orifices in the nozzle tip where it mixes with combustion air supplied through the third passage and discharged through an annular orifice radially adjacent the diffusion fuel orifices. The mixture is ignited in the combustion chamber or burning zone within the liner by a conventional spark plug and crossfire tube arrangement. It will be appreciated that, in the diffusion mode, fuel supply to the premix passage is shut off.

At higher (normal) turbine loads, fuel is supplied to the premix passage (the first passage) for injection into the premix tubes, by means of the radially extending fuel distribution tubes, where the fuel is thoroughly mixed with compressor air reverse flowed into the combustor by means of the swirlers and premix tubes. This mixture is ignited by the existing flame in the burning zone. Once the premixed mode has commenced, fuel to the diffusion passage is shut off.

Thus, in its broader aspects, the invention provides in a low NOx gas turbine, a plurality of combustors, each having a plurality of fuel nozzles arranged about a longitudinal axis of the combustor, and a single combustion zone; each fuel nozzle having a diffusion passage and a premix passage, the premix passage communicating with a plurality of premix fuel distribution tubes located within a dedicated premix tube adapted to mix premix fuel and combustion air prior to entry into the single combustion zone located downstream of the premix tube.

Thus, the objectives of this invention are to obtain in the premixed mode of a dual mode (diffusion/-premixed), single stage combustor, thorough premixing of fuel and air, prior to burning by using multiple dedicated premixing sections or tubes upstream of the burning zone of the combustor. It is also the objective of this invention to provide stable operation in the dual mode combustor by employing both swirl and bluff body flame stabilization.

Other objects and advantages of the invention will become apparent from the detailed description which follows.

BEST MODE FOR CARRYING OUT THE INVENTION

Figure 1:
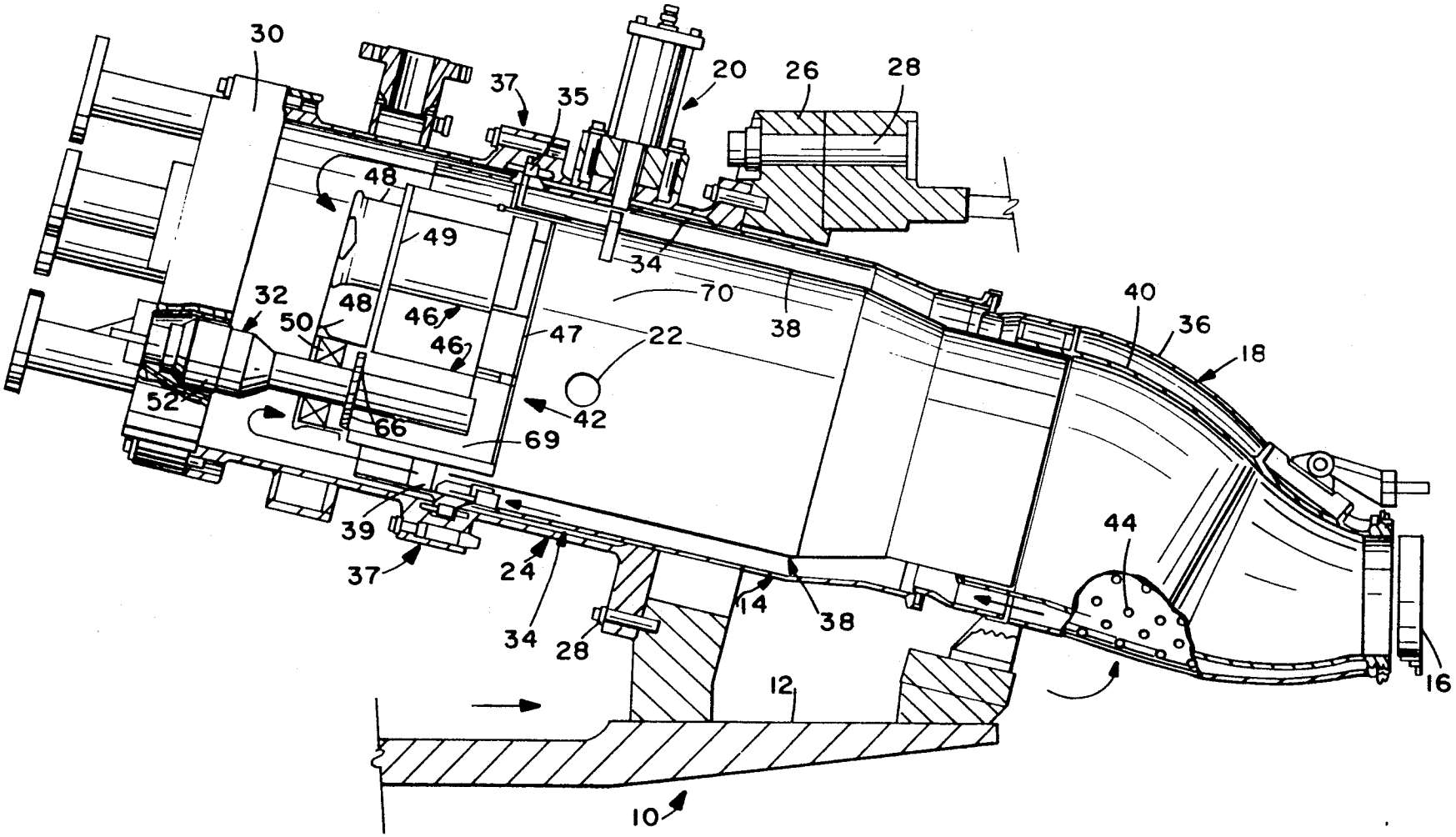
FIG. 1 is a partial section through one combustor of a gas turbine in accordance with an exemplary embodiment of the invention.

With reference to FIG. 1, the gas turbine 10 includes a compressor 12 (partially shown), a plurality of combustors 14 (one shown), and a turbine represented here by a single blade 16. Although not specifically shown, the turbine is drivingly connected to the compressor 12 along a common axis. The compressor 12 pressurizes inlet air which is then reverse flowed to the combustor 14 where it is used to cool the combustor and to provide air to the combustion process.

As noted above, the gas turbine includes a plurality of combustors 14 located about the periphery of the gas turbine. A double-walled transition duct 18 connects the outlet end of each combustor with the inlet end of the turbine to deliver the hot products of combustion to the turbine.

Ignition is achieved in the various combustors 14 by means of spark plug 20 in conjunction with cross fire tubes 22 (one shown) in the usual manner.

Each combustor 14 includes a substantially cylindrical combustion casing 24 which is secured at an open forward end to the turbine casing 26 by means of bolts 28. The rearward end of the combustion casing is closed by an end cover assembly 30 which may include conventional supply tubes, manifolds and associated valves, etc. for feeding gas, liquid fuel and air (and water if desired) to the combustor as described in greater detail below. The end cover assembly 30 receives a plurality (for example, five) fuel nozzle assemblies 32 (only one shown for purposes of convenience and clarity) arranged in a circular array about a longitudinal axis of the combustor (see FIG. 5).

Within the combustor casing 24, there is mounted, in substantially concentric relation thereto, a substantially cylindrical flow sleeve 34 which connects at its forward end to the outer wall 36 of the double walled transition duct 18. The flow sleeve 34 is connected at its rearward end by means of a radial flange 35 to the combustor casing 24 at a butt joint 37 where fore and aft sections of the combustor casing 24 are joined.

Within the flow sleeve 34, there is a concentrically arranged combustion liner 38 which is connected at its forward end with the inner wall 40 of the transition duct 18. The rearward end of the combustion liner 38 is supported by a combustion liner cap assembly 42 which is, in turn, supported within the combustor casing by a plurality of struts 39 and associated mounting flange assembly 41 (best seen in FIG. 5). It will be appreciated that the outer wall 36 of the transition duct 18, as well as that portion of flow sleeve 34 extending forward of the location where the combustion casing 24 is bolted to the turbine casing (by bolts 28) are formed with an array of apertures 44 over their respective peripheral surfaces to permit air to reverse flow from the compressor 12 through the apertures 44 into the annular space between the flow sleeve 34 and the liner 38 toward the upstream or rearward end of the combustor (as indicated by the flow arrows shown in FIG. 1).

Figure 5:
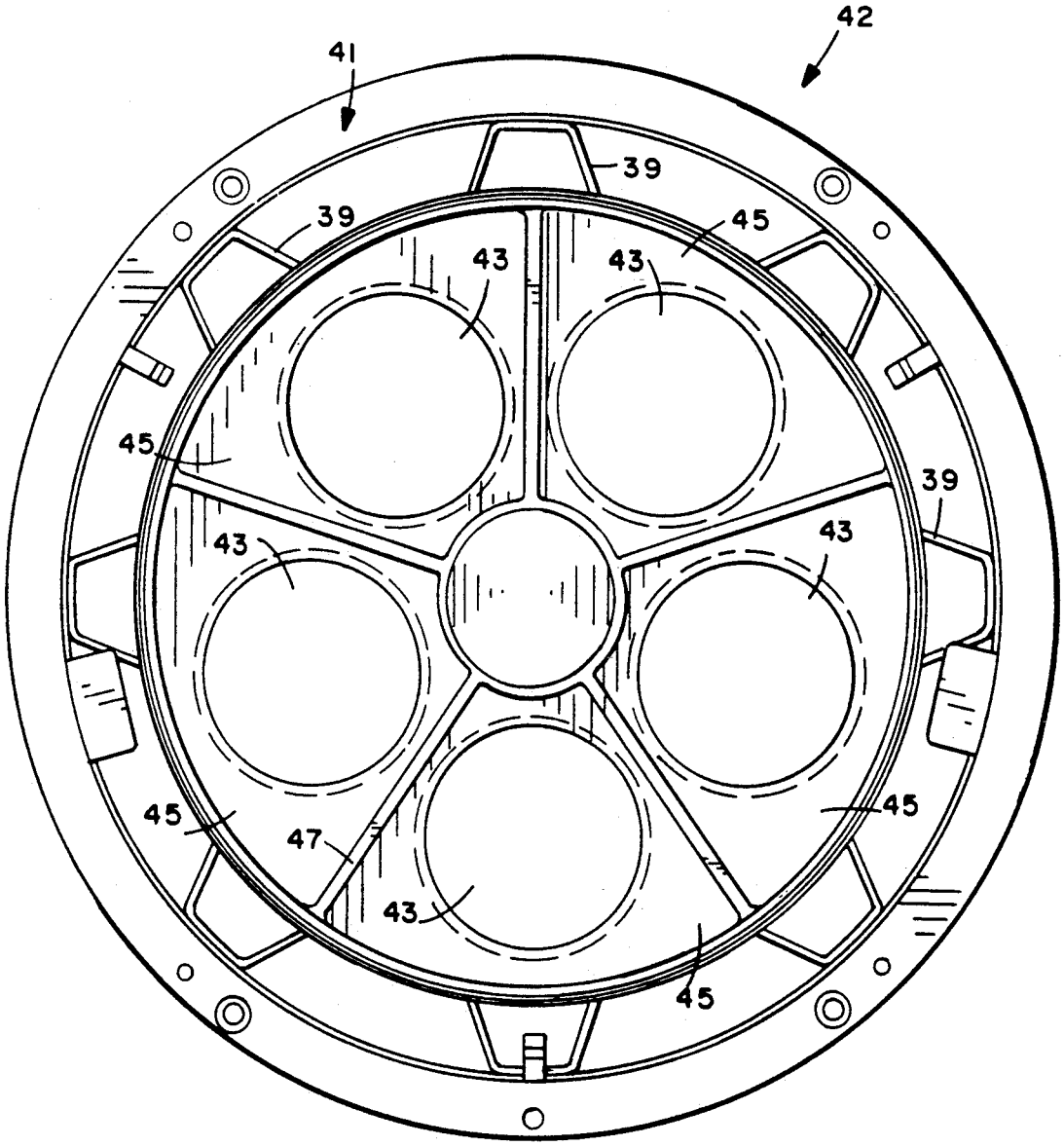
FIG. 5 is a front end view of the combustion liner cap assembly incorporated in the combustor illustrated in FIG. 1, with nozzles omitted for clarity.

The combustion liner cap assembly 42 supports a plurality of premix tubes 46, one for each fuel nozzle assembly 32. More specifically, each premix tube 46 is supported within the combustion liner cap assembly 42 at its forward and rearward ends by front and rear plates 47, 49, respectively, each provided with openings aligned with the open-ended premix tubes 46. This arrangement is best seen in FIG. 5, with openings 43 shown in the front plate 47. The front plate 47 (an impingement plate provided with an array of cooling apertures) may be shielded from the thermal radiation of the combustor flame by shield plates 45.

The rear plate 49 mounts a plurality of rearwardly extending floating collars 48 (one for each premix tube 46, arranged in substantial alignment with the openings in the rear plate), each of which supports an air swirler 50 in surrounding relation to a radially outermost tube of the nozzle assembly 32. The arrangement is such that air flowing in the annular space between the liner 38 and flow sleeve 32 is forced to again reverse direction in the rearward end of the combustor (between the end cap assembly 30 and sleeve cap assembly 44) and to flow through the swirlers 50 and premix tubes 46 before entering the burning zone within the liner 38, downstream of the premix tubes 46. As noted above, the construction details of the combustion liner cap assembly 42, the manner in which the liner cap assembly is supported within the combustion casing, and the manner in which the premix tubes 46 are supported in the liner cap assembly is the subject of co-pending application Ser. No. 859,007, incorporated herein by reference.

Figure 2:
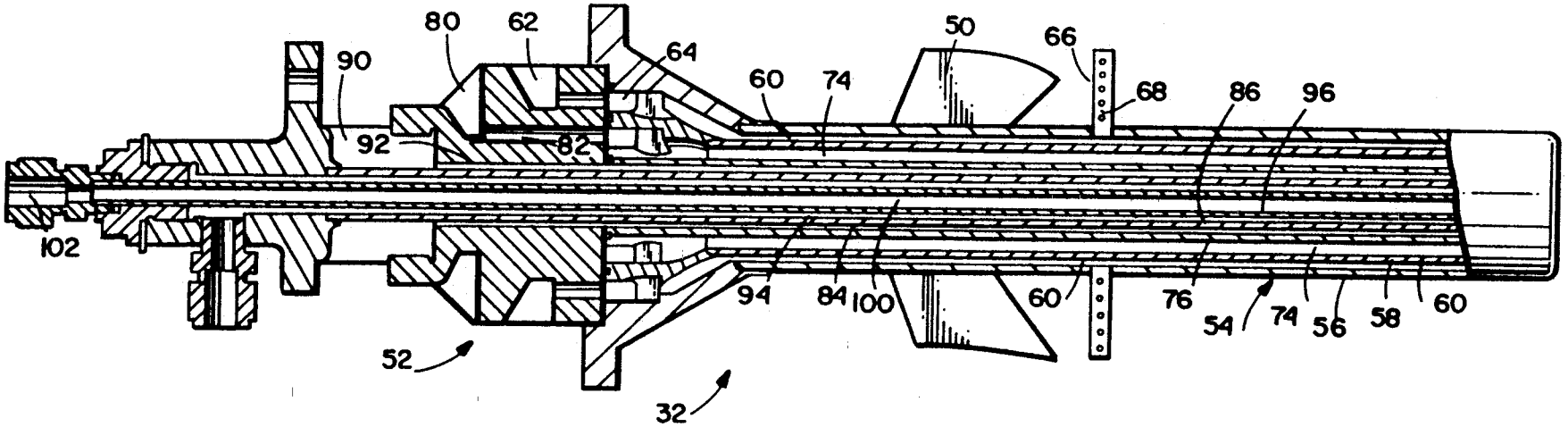
FIG. 2 is a sectional view of a fuel injection nozzle in accordance with an exemplary embodiment of the invention.
Figure 3:
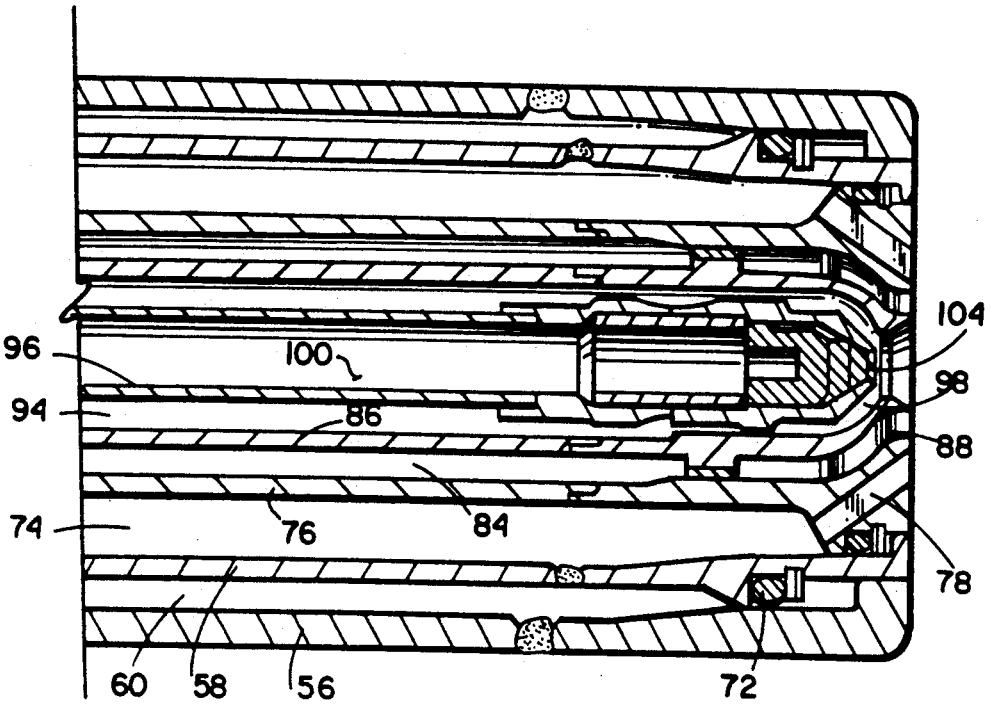
FIG. 3 is an enlarged detail of the discharge or forward end of the nozzle shown in FIG. 2.
Figure 4:
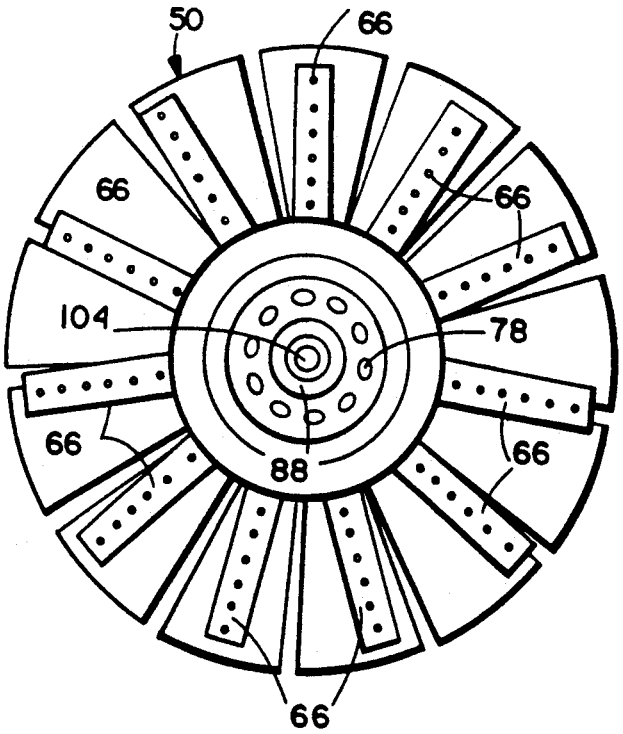
FIG. 4 is a front end view of the nozzle illustrated in FIGS. 1-3.

Turning to FIGS. 2 and 3, each fuel nozzle assembly 32 includes a rearward supply section 52 with inlets for receiving liquid fuel, atomizing air, diffusion gas fuel and premix gas fuel, and with suitable connecting passages for supplying each of the above mentioned fluids to a respective passage in a forward delivery section 54 of the fuel nozzle assembly, as described below.

The forward delivery section 54 of the fuel nozzle assembly is comprised of a series of concentric tubes. The two radially outermost concentric tubes 56, 58 provides a premix gas passage 60 which receives premix gas fuel from an inlet 62 connected to passage 60 by means of conduit 64. The premix gas passage 60 also communicates with a plurality (for example, eleven) radial fuel injectors 66, each of which is provided with a plurality of fuel injection ports or holes 68 for discharging gas fuel into a premix zone 69 located within the premix tube 46. The injected fuel mixes with air reverse flowed from the compressor 12, and swirled by means of the annular swirler 50 surrounding the fuel nozzle assembly upstream of the radial injectors 66.

The premix passage 60 is sealed by an O-ring 72 at the forward or discharge end of the fuel nozzle assembly, so that premix fuel may exit only via the radial fuel injectors 66.

The next adjacent passage 74 is formed between concentric tubes 58 and 76, and supplies diffusion gas to the burning zone 70 of the combustor via orifice 78 at the forwardmost end of the fuel nozzle assembly 32. The forwardmost or discharge end of the nozzle is located within the premix tub 46, but relatively close to the forward end thereof. The diffusion gas passage 74 receives diffusion gas from an inlet 80 via conduit 82.

A third passage 84 is defined between concentric tubes 76 and 86 and supplies air to the burning zone 70 via orifice 88 where it then mixes with diffusion fuel exiting the orifice 78. The atomizing air is supplied to passage 84 from an inlet 90 via conduit 92.

The fuel nozzle assembly 32 is also provided with a further passage 94 for (optionally) supplying water to the burning zone to effect NOx reductions in a manner understood by those skilled in the art. The water passage 94 is defined between tube 86 and adjacent concentric tube 96. Water exits the nozzle via an orifice 98, radially inward of the atomizing air orifice 88.

Tube 96, the innermost of the series of concentric tubes forming the fuel injector nozzle, itself forms a central passage 100 for liquid fuel which enters the passage by means of inlet 102. The liquid fuel exits the nozzle by means of a discharge orifice 104 in the center of the nozzle. It will be understood by those skilled in the art that the liquid fuel capability is provided as a back-up system, and passage 100 is normally shut off while the turbine is in its normal gas fuel mode.

The above described combustor is designed to act in a dual mode, single stage manner. In other words, at low turbine loads, and in each nozzle/dedicated premix tube assembly, diffusion gas fuel will be fed through inlet 80, conduit 82 and passage 74 for discharge via orifice 78 into the burning zone 70 where it mixes with atomizing air discharged from passage 84 via orifice 88. This mixture is ignited by spark plug 20 and burned in the zone 70 within the liner 38.

At higher loads, again in each nozzle/dedicated premix tube assembly, premix gas fuel is supplied to passage 60 via inlet 62 and conduit 64 for discharge through orifices 68 in radial injectors 66. The diffusion fuel mixes with air entering the premix tube 46 by means of swirlers 50, the mixture igniting in burning zone 70 in liner 38 by the pre-existing flame from the diffusion mode of operation. During premix operation, fuel to the diffusion passage 74 is shut down.

It will be appreciated that combustion liner cooling may be achieved by axially spaced slot cooling rings, passive backside cooling, impingement cooling or any combination thereof. It will further be appreciated that combustion/cooling air may be supplied directly to the combustion liner cap assembly (exteriorly of the premix tubes) by means of cooling holes formed in the outer sleeve of the assembly, which serve to direct air against the forward impingement plate and through the cooling apertures formed therein, to supplement the compressor air flowing through the dedicated premix tubes. The swirling flow field exiting the premix tubes, coupled with the sudden expansion into the combustion liner, assist in establishing a stable burning zone within the combustor.

In an alternative arrangement, a small percentage of fuel supplied to the radial premix gas injectors may be diverted to the downstream end of the nozzle to provide a diffusion flame ignition source (a sub-pilot). The primary purpose of this diffusion sub-pilot is to provide enhanced stability while in the premixed mode of operation.

From the above description, it will be apparent that the twin objectives of obtaining thorough premixing of fuel and air prior to burning while at the same time achieving operational stability is accomplished by this invention.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. In a gas turbine, a plurality of combustors, each having a plurality of fuel nozzles arranged about a longitudinal axis of the combustor, and a single combustion zone, each fuel nozzle having a diffusion gas passage connected to a diffusion gas inlet and a premix gas passage connected to a premix gas inlet, the premix gas passage communicating with a plurality of premix fuel distribution tubes extending radially away from said premix gas passage, and located within a dedicated premix tube adapted to mix premix fuel and combustion air prior to entry into the single combustion zone located downstream of the premix tube, and wherein said diffusion gas passage terminates at a forwardmost discharge end of said fuel nozzle downstream of said premix fuel distribution tubes but within said dedicated premix tube, and wherein said plurality of radially extending premix fuel distribution tubes are located upstream of said forwardmost end.

2. The gas turbine of claim 1 wherein said fuel nozzle also includes an air passage.

3. The gas turbine of claim 1 wherein an air swirler extends radially between said fuel nozzle and said premix tube, upstream of said radially extending premix fuel distribution tubes.

4. The gas turbine of claim 1 wherein said fuel nozzle includes a water passage for discharging water into said burning zone.

5. The gas turbine of claim 1 wherein said plurality of nozzles comprises five, arranged in a circular array about said longitudinal axis of the combustor.

6. The gas turbine of claim 1 wherein each combustor includes a combustor casing, a flow sleeve, and a liner mounted concentrically with respect to each other.

7. The gas turbine of claim 6 wherein said premix tubes are mounted in a cap assembly secured to an upstream end of the flow sleeve.

8. A single stage, dual mode gas turbine combustor comprising:

a combustor casing having an open forward end and an end cover assembly secured to a rearward end thereof;

a flow sleeve mounted within said casing;

a sleeve cap assembly secured to said casing and located axially downstream of said end cover assembly;

a combustion liner having forward and rearward ends, the rearward end secured to said sleeve cap assembly, said combustion liner having a single combustion zone;

a plurality of fuel nozzle assemblies arranged in a circular array about a longitudinal axis of the combustor, and extending from said end cover assembly and through said sleeve cap assembly, each fuel nozzle assembly including a diffusion gas fuel passage and a premix gas fuel passage; and a plurality of premix tubes secured to said sleeve cap assembly, each premix tube surrounding a forward portion of a corresponding one of said fuel nozzle assemblies including a plurality of premix gas distribution tubes; and flow path means for permitting air to flow through said premix tubes in an upstream to downstream direction, past said premix gas distribution tubes to a burning zone in said liner downstream of said premix tubes.

9. The gas turbine combustor of claim 8 wherein said flow path means includes an air swirler at an inlet end of each premix tube.

10. The gas turbine combustor of claim 8 wherein each fuel nozzle assembly further includes an atomizing air passage and a liquid fuel passage.

11. The gas turbine combustor of claim 10 wherein all of said fuel nozzle passages have at least partial concentricity with each other.

12. The gas turbine combustor of claim 8 wherein said diffusion gas passage extends axially of said fuel nozzle assembly, and wherein said premix gas fuel passage communicates with a plurality of radially extending fuel distribution tubes arranged circumferentially about said fuel nozzle assembly.

* * * * *